United States Patent [19]

Petrovich

[11] 4,368,116

[45] Jan. 11, 1983

[54] POLYHYDROXY FATTY ACIDS COLLECTOR-FROTHERS

[76] Inventor: Vojislav Petrovich, 1935 W. Schiller St., Chicago, Ill. 60622

[21] Appl. No.: 241,560

[22] Filed: Mar. 9, 1981

[51] Int. Cl.[3] ..... B03D 1/14

[52] U.S. Cl. ..... 209/166; 252/61

[58] Field of Search ..... 209/166, 167

[56] References Cited

U.S. PATENT DOCUMENTS

| | | | |
|---|---|---|---|
| 1,912,433 | 6/1933 | Crago | 209/166 |
| 2,012,609 | 8/1935 | Lenher | 209/166 |
| 2,023,388 | 12/1935 | Harris | 209/166 X |
| 2,099,120 | 11/1937 | Kirby | 209/166 |
| 2,120,217 | 6/1938 | Harris | 209/166 |
| 2,362,432 | 11/1944 | Cahn | 209/166 |
| 3,859,208 | 1/1975 | Knocke | 209/166 |
| 3,909,399 | 9/1975 | Petrovich | 209/166 |
| 4,148,720 | 4/1979 | Wang | 209/166 |

*Primary Examiner*—Norman Yudkoff

[57] ABSTRACT

Beneficiation of metallic oxide ores by froth flotation process using polyhydroxy fatty acids collector-frothers in the presence of silica, silicates, and the like gangue minerals to obtain pure concentrates of desired metal values; comprises, adding to a water suspension of finely divided ore material of polyhydroxy fatty acids to collect the metal value, leaving unaffected gangue minerals.

1 Claim, No Drawings

POLYHYDROXY FATTY ACIDS COLLECTOR-FROTHERS

This invention relates to froth flotation of non-sulfide minerals from their ores using polyhydroxy fatty acids as collector-frothers, and more particularly to the recovery of such metallic oxide minerals which are imbedded in a matrix of silica, silicates and the like mineral matrixes.

The object of this invention is to provide improved collector-frothers of the group of fatty acids through the application in froth flotation of polyhydroxy fatty acids. Said polyhydroxy fatty acids as collectors are superior to ordinary saturated or unsaturated fatty acids because they develop more and tougher froth with greater bubbles than any known fatty acid. A tougher froth of larger bubbles is capable to levitate and carry coarser sized flotation feed, which is a great advantage of the application of polyhydroxy fatty acids. Thus, a more selective separation can be made between valuable oxide minerals floated, persevering at the same time the silica, the silicates, and the like gangue material to be dispersed and depressed. As the application has shown the bubbles are more wett therefore repellent to gangue minerals, the silica, the silicates, and the like gangue minerals.

Froth flotation is roughly based on the fact that the surface of a given mineral to be recovered can be rendered, by the action of so-called collectors, more or less water repellent, i.e., aerophil, and the mineral-air complex, the specific gravity of which is lower than that of the pulp of mineral slurry, is thus formed with the air bubbles introduced into the pulp of mineral slurry. The binding of the collector to the surface of the mineral by forces of chemiadsorption, physical-adsorption, ect., is due to olectrostatic forces in both of the collector itself and the said surfaces. Thus, the positive electrostatic forces of a collector no matter of which active group they provenience exhibit adsorpting forces to mineral. Contrary, the negative electrostatic forces which are inherent to acid parts of minerals and hydroxyl groups of collectors and frothers exhibit wetting properties, i.e., are water-avide therefore aid in depressing of the wetted mineral particles, while if present in a collector or frother exhibit frothing properties.

It is the custom to speak about "differential" flotation, only in the case of polymetallic concentration, but most of the usual monometallic flotation are also differential ones, as the gangue has to be prevented from floating together with the wanted metallic mineral. If the used collector has a tendency to be adsorbed by the gangue minerals (which is particularly the case of paraffinic oils, fatty acids, fatty alcohols, sulfated and sulfonated alkyl compounds, as well as the amines ect., chiefly used in the flotation of metallic oxide ores and non-metallic ores) the latter must be "depressed". Roughly, depression consists in the action of preventing the binding of the collecting reagent to the surface of a certain mineral, which is not wanted in the concentrate. In the case of monometallic flotation, the gangue minerals are mostly silica, silicates, and the like acid minerals. Said minerals suspended in water, i.e., the mineral slurry, exhibit strong negative effect. Thus, to prevent them of floating the collector-frother must exhibit also strong negative effect, besides its specific collecting power. Said negative effect is manifested on the surface of the bubbles which exhibit a strong repellent effect towards negatively charged gangue minerals, except when expresly specific to certain metal value. The added frother, the former of the bubbles, exhibit partially said negative and repellent effect on the gangue minerals. Very often it is needed to add depressant to augment the wetting of the gangue minerals, i.e., the said negative and repellent forces, which keeps gangue from floating and preventing from concentrating in the froth, thus clean the concentrates of metallic minerals, mostly of oxide character, which are concentrated.

It is well known that fatty acids having good collecting power acting with the carboxylic group have mostly poor frothing power, having no independent hydroxyl group or groups in their molecules. The carboxyl group has not sufficiently and satisfactory frothing power, even not sufficiently selective power, i.e., gangue repellent power. Therefore, this invention has developed dihydroxy, trihydroxy, and tetrahydroxy fatty acids, especially such as di-, tri-, and tetrahydroxy stearic and oleic acids, which are the most accessible and the cheapest industrial products. Thus, the object of this present invention is to introduce in common fatty acids two or more hydroxyl groups, thus forming polyhydroxy fatty acids, accomplishing in this way a highly hydrophilic froth to which no negatively charged gangue mineral particle of silica or silicates group or the like acid compounded metallic minerals can attach, while the carboxylic group specific to certain metals will float the same metal value on a clean and tough froth.

The further advantage of this invention resides in the formation of a tough froth which is capable to carry bigger particles than the froth of any common fatty acid. This advantage is important because the investment in the instalation as well as the operating costs are lower, i.e., the through-put of the ore feed through the mill is higher, the capacity of milling and sizing is augmented, while the coarse grain flotation need less reagents per ton of ore treated.

It is therefore obvious that the aims in the flotation of ores to recover the valuable minerals is directed firstly toward increasing the floatability of the wanted mineral as coarse as possible; secondly, toward minimizing any flotation tendency exhibited by the unwanted gangue minerals contained in the mixture of the suspended mineral slurry.

The present invention has both aims in view, the first and the second aims and objectives for the accomplishement of the same, it proposes to add to the flotation pulp of mineral slurry relatively smaller amounts of polyhydroxy fatty acids, which will be described presently, which react as strong collector-frothers, preventing the flotation of unwanted gangue minerals of the oxide ore matrix, thus supplying coarser concentrates diminuting the cost of concentration. Thus both aims superiorly fulfil the flotation of oxide ore than the common fatty acids.

The polyhydroxy fatty acid collector-frothers which are the specific subject of this invention have the following structural characteristics:

| | |
|---|---|
| Dihydroxystearic acid | $CH_3(CH_2)_7-\underset{OH}{CH}-\underset{OH}{CH}-CH_2(CH_2)_7COOH$ |
| Trihydroxystearic acid | $CH_3(CH_2)_5\underset{OH}{CH}-CH_2-\underset{OH}{CH}-\underset{OH}{CH}-(CH_2)_7COOH$ |
| Tetrahydroxystearic acid | $CH_3(CH_2)_2-\underset{OH}{CH}-\underset{OH}{CH}-(CH_2)_3-\underset{OH}{CH}-\underset{OH}{CH}-(CH_2)_7COOH$ |
| Dihydroxyoleic acid | $CH_3(CH_2)_2-\underset{OH}{CH}-\underset{OH}{CH}-(CH_2)_3-CH{=}CH(CH_2)_7COOH$ |
| Tetrahydroxyoleic acid | $CH_3(CH_2)_2-\underset{OH}{CH}-\underset{OH}{CH}-(CH_2)_3-\underset{OH}{CH}-\underset{OH}{CH}-(CH_2)_2-CH{=}CH(CH_2)_3COOH$ |

Said polyhydroxy fatty acids ensue by the oxidation of unsaturated fatty acids with potassium permanganate in alkaline solution, or by treating of unsaturated fatty acids with potassium or sodium hydroxide solution at 100° C. The method of production of said polyhydroxy fatty acids is not the subject of this invention, but their use as froth flotation reagents the collector-frothers is the object of this invention, because they are a new class of collector-frothers in fatty acid group of collectors in froth flotation of minerals.

Said polyhydroxy fatty acids are more readily soluble in water than their non-hydroxy fatty acids counterpart. Their potassium and sodium salts are also more readily dissolved in water than their non-hydroxy fatty acids alkali soaps counterpart, which by itself is a great advantage in froth flotation, because the collection may be performed with a lesser amount of said polyhydroxy fatty acid alkali salts collector-frothers than even with dispersed common fatty acids or their alkali salts. Thus, no disperssants are needed. It is observed that as the number of hydroxyl groups augment the solubility and the frothing properties augment.

The said advantages in froth flotation of metal oxide ores in a matrix of silica, silicates, and the like acidic minerals is shown on the following table. The comparison of the floating power is correlated between oleic acid (OA) of Emery Chemical Co. and dihydroxy oleic acid (DHOA) prepared by the applicant. The scheduled ore samples are of natural ore mined. The increments of operated froth flotation comparisons were of the amount of 400 grams each. The used ores in this comparisons have had about 35% (30–40) of valuable mineral to be floated and recovered, therefore, the amount of added oleic acid potassium salt as well as of the added dihydroxy oleic acid potassium salt were of the same order, i.e., 0.4 kg per ton of ore treated.

| | Distribution of sizes in concentrates | | | | | |
|---|---|---|---|---|---|---|
| Ore treated | mesh + 48 % OA | mesh + 48 % DHOA | mesh + 100 % OA | mesh + 100 % DHOA | mesh − 100 % OA | mesh − 100 % DHOA |
| Cervantite $Sb_2O_3$ | 39 | 46 | 36 | 44 | 22 | 10 |
| Psilomelan $MnO_2$ | 12 | 22 | 48 | 58 | 40 | 20 |
| Hematite $Fe_2O_3$ | 40 | 48 | 40 | 50 | 20 | 2 |
| Magnetite $Fe_3O_4$ | 14 | 21 | 40 | 58 | 46 | 21 |
| Chromite $Cr_2O_3$ | 10 | 16 | 48 | 62 | 42 | 22 |

The comparison of the results shows that the ratio of coarse material either in concentrate or tailings is considerably augmented by conditioning the pulp of mineral slurry with a potassium salt of polyhydroxy fatty acid potassium salt of this invention. Therefore, the use, according to the present invention of polyhydroxy fatty acids for accomplishing the purpose of coarser flotation of valuable minerals as well as of gangue depression through the application of the same in froth flotation of various oxide minerals of a variety responsive to polyhydroxy fatty acids collector-frothers constitutes a marked advance in the art of froth flotation, and is highly advantageous in diminuting the investment and operating costs per ton of processed ore, because the milling and sizing costs are the highest costs in ore beneficiation, besides of the improved selectivity of the used collector-frothers of this invention, thus improving the profit-making business.

The selectivity of dihydroxy as well as of polyhydroxy fatty acids against gangue minerals, the silica, and the silicates was perfect. No grain of gangue minerals were observed in concentrates, so the recoveries were not calculated, because there was not contamination of concentrates with visible gangue minerals, nor the tailings contained grain of valuable minerals, nor a middling was produced. All investigated polyhydroxy fatty acids potassium salts yielded high recoveries not only because of high responsiveness of investigated minerals but also because of excellent carrying froth developed by said hydroxylated fatty acids. In tailings there were visible only the rare coarse particles of metal value floated.

What is claimed is:

1. In concentrating by froth flotation of metallic ores selected from the group of oxide ores mixed with gangue minerals selected from the group of silica, silicates, and the like acid minerals which includes the subjecting of said ore material when finely ground to froth flotation process; the step of adding to the mineral slurry an amount of the order of 0.1 kg to 0.5 kg per ton of ore treated potassium salts of polyhydroxy fatty acids; said polyhydroxy fatty acids selected from the class consisting of 2 to 4 hydroxyl groups designated as: dihydroxystearic acid, trihydroxystearic acid, tetrahydroxystearic acid, dihydroxyoleic acid, tetrahydroxyoleic acid; said acids are applied in froth flotation process as potassium salts; being collector-frothers said potassium salts of said polyhydroxy fatty acids exhibit coarse-grain flotation of oxide minerals augmenting the non-responsiveness of gangue minerals, thus producing high grade concentrates of responsive metallic oxide minerals.

* * * * *